US011685621B2

(12) United States Patent
Hanke

(10) Patent No.: US 11,685,621 B2
(45) Date of Patent: Jun. 27, 2023

(54) FEEDER OF A SHEET TREATING OR PROCESSING MACHINE, AND METHOD FOR DETECTING AND/OR CORRECTING SHEETS HAVING DEVIATING POSITIONS AND/OR DIMENSIONS IN A FEEDER OF A SHEET TREATING OR PROCESSING MACHINE

(71) Applicant: KOENIG & BAUER AG, Würzburg (DE)

(72) Inventor: Bernd Hanke, Dresden (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/621,311

(22) PCT Filed: May 21, 2021

(86) PCT No.: PCT/EP2021/063611

§ 371 (c)(1),
(2) Date: Dec. 21, 2021

(87) PCT Pub. No.: WO2022/058058

PCT Pub. Date: Mar. 24, 2022

(65) Prior Publication Data

US 2022/0348430 A1 Nov. 3, 2022

(30) Foreign Application Priority Data

Sep. 18, 2020 (DE) ..... 102020124432.0

(51) Int. Cl.
*B65H 3/08* (2006.01)
*B65H 1/04* (2006.01)
(Continued)

(52) U.S. Cl.
CPC ..... *B65H 3/0816* (2013.01); *B65H 1/04* (2013.01); *B65H 7/08* (2013.01); *B65H 7/20* (2013.01);
(Continued)

(58) Field of Classification Search
CPC ..... B65H 3/0816; B65H 7/08; B65H 9/10; B65H 9/103; B65H 9/105; B65H 2553/45; B65H 2553/82
See application file for complete search history.

(56) References Cited

U.S. PATENT DOCUMENTS 5,037,080 A 8/1991 Wirz
5,803,447 A * 9/1998 Singer ..... B65H 3/0816 271/107
(Continued)

FOREIGN PATENT DOCUMENTS

DE 10100191 A1 8/2002
DE 10151484 A1 5/2003
(Continued)

*Primary Examiner* — Prasad V Gokhale
(74) *Attorney, Agent, or Firm* — Mattingly & Malur, PC

(57) ABSTRACT

A feeder of a sheet treating or a sheet processing machine comprises a sensor system, which sensor system, on a front side pointing in a direction of transport of the sheets to be fed or on the opposing, rear side of the pile of sheets to be fed, comprises one or more sensors, by the use of which sensors, a distance, with respect to at least two locations, which are spaced apart from one another transversely to the transport direction, at the relevant front or rear sides of the pile, can be ascertained. A method is provided for detecting or correcting sheets having deviated positions or dimensions in such a sheet feeder of a sheet treating or processing machine.

14 Claims, 8 Drawing Sheets

(51) Int. Cl.

| | |
|---|---|
| ***B65H 7/08*** | (2006.01) |
| ***B65H 7/20*** | (2006.01) |
| ***B65H 9/10*** | (2006.01) |

(52) U.S. Cl.
CPC ..... *B65H 9/103* (2013.01); *B65H 2553/45* (2013.01); *B65H 2553/82* (2013.01)

(56) References Cited

U.S. PATENT DOCUMENTS

| | | | | |
|---|---|---|---|---|
| 6,481,953 | B1 * | 11/2002 | Michel | B65H 3/0825 414/796 |
| 2006/0208414 | A1 * | 9/2006 | Amarakoon | B65H 7/08 271/10.02 |

FOREIGN PATENT DOCUMENTS

| | | | |
|---|---|---|---|
| DE | 102004005575 | A1 | 9/2004 |
| DE | 10356107 | A1 | 6/2005 |
| DE | 112007001617 | T5 | 8/2009 |
| DE | 102015204553 | B4 | 4/2013 |
| DE | 102015204558 | B4 | 4/2018 |

* cited by examiner

FEEDER OF A SHEET TREATING OR PROCESSING MACHINE, AND METHOD FOR DETECTING AND/OR CORRECTING SHEETS HAVING DEVIATING POSITIONS AND/OR DIMENSIONS IN A FEEDER OF A SHEET TREATING OR PROCESSING MACHINE

CROSS-REFERENCE TO RELATED APPLICATIONS

This application is the US national phase, under 35 USC section 371, of PCT/EP2021/063611, filed May 21, 2021, and claiming priority to DE 10 2020 124 432.0, filed Sept. 18, 2020, the disclosures of which are expressly incorporated herein in their entireties by reference.

FIELD OF THE INVENTION

The present invention relates to a feeder of a sheet treating or processing machine, and to a method for detecting and/or correcting sheets having deviating positions and/or dimensions in a feeder of a sheet treating or processing machine. The feeder of a sheet treating or a sheet processing machine, in which a pile of sheets to be processed can be received, comprises at least two first handling tools which are spaced apart from one another transversely to a transport direction of the sheets, and by the use of which, an uppermost sheet of a pile of sheets received in the feeder can be lifted off the pile. At least two second handling tools, which are spaced apart from one another transversely to a transport direction of the sheets, and by the use of which an uppermost sheet lifted off the pile can be transported away from the pile in the transport direction into a transport path adjoining downstream, are provided. In the method for detecting or correcting sheets having deviated positions or dimensions in the feeder of a sheet treating a processing machine, it is possible successively to lift off the respective uppermost sheet of a pile of sheets by the use of the at least two first handling tools which are spaced apart from one another transversely to a transport direction of the sheets or to transport these sheets away from the pile in the transport direction into a transport path adjoining downstream by the use of the two second handling tools which are spaced apart from one another transversely to a transport direction of the sheets.

BACKGROUND OF THE INVENTION

Feeders are used on sheet processing printing presses to separate sheets made of different materials that are arranged in piles and to feed them via conveying means and, e.g., a feed table to the printing press. The separating and feeding of the sheets is carried out by what are known as feeder heads. The positions of the sheets in the pile and the actual dimensions thereof are generally unknown. Sheets can have tolerances of more than 1 mm in their cut lengths and be situated offset or obliquely in the pile. Both states can result in errors in the separation or feeding of the sheets into the printing press. Common errors then include, e.g., skew sheets, early or late sheets, and also double sheets. In such a case, there is the risk of having to interrupt the printing process and stop the machine. It is then necessary for the operator to intervene manually to remove the non-conforming sheet.

A device for aligning sheets is known from DE 10 2015 204 558 B4, wherein a monitoring device detecting the actual position of the leading edge of the foremost sheet conveyed on the feed table by conveying means is provided at the feed table, and a possibly necessary correction of the sheet is induced at the feed table by two conveyor belts that are driven independently of one another.

DE 10 2004 005 575 A1 relates to the ascertainment of a height at which an uppermost sheet of a pile, i.e., the position of the upper pile edge, is located. This is achieved in that an optical sensor, which is directed from above at the pile front edges, only conducts a measurement when the front stop is shut off, and the uppermost layers of the pile are at rest, after potentially trapped blower air has escaped.

DE 101 51 484 A1 discloses a sheet feeder for cyclically conveying sheets by way of suckers, wherein the position of a leading edge of the sheet to be received or having been received is detected by way of optical sensors, which are carried along by the suckers and directed from above or beneath at the leading sheet edge. A deviation from the course perpendicular to the transport direction prompts a one-sided lead or lag in the motion of the suckers.

DE 11 2007 001 617 T5 relates to setting a working pressure that is applied to an ejector of a sucker, which is operated with high pressure, to a working pressure that is adapted to the corresponding sheet and/or the operation of the printing press by comparing a measured working pressure and a predefined working pressure. The working pressure is carried out at a negative pressure or overpressure delivered by the ejector.

DE 103 56 107 A1 relates to a sheet feeder including leading edge separation and contactless pile sensing, wherein a sensor device for contactlessly detecting the height of the upper pile side of the pile of sheets relative to the sucker can be directed at the upper pile side of the pile of sheets on at least one sucker receiving the uppermost sheet.

U.S. Pat. No. 5,037,080 discloses a device for scanning the length of a sheet, which comprises fall-type suckers that are provided in the feeder and that, with a scanning borehole, are directed at the trailing edge of the uppermost sheet.

DE 101 00 191 A1 relates to a sheet feeder to which a sensor detecting a distance is assigned for establishing the format of the stacked sheets and for detecting the position of the pile with respect to a machine center on both sides of the pile and at the rear. After the pile position has been detected with respect to the machine center, working elements of the machine are actuated accordingly, and the sensors on one of the sides and on the rear side of the pile are deactivated.

SUMMARY OF THE INVENTION

The object of the present invention is to devise an improved feeder of a sheet treating or processing machine, and a method for detecting and/or correcting sheets having deviating positions and/or dimensions in a feeder of a sheet treating or processing machine.

The object of the present invention is achieved according to the invention by the provision of a sensor system which, on the front side of the pile of sheets, and pointing in the transport direction of the sheets to be fed, comprises one or more sensors, by the use of which one or more sensors a piece of information about a distance, with respect to at least two locations, which are spaced apart from one another transversely to the transport direction, on the front side of the pile of sheets, can be ascertained. A sensor system on the rear side of the pile of sheets, and which is directed counter to the transport direction, comprises one or more sensors, by the use of which sensors a piece of information about a distance, with respect to at least two locations, which are spaced apart from one another transversely to the transport direction, on the rear side of the pile, can be ascertained. Sheets to be fed to the treating or processing machine monitored by the sensor system, with respect to a position or a dimension of the sheets, are evaluated. Results of the evaluation are visualized or are used for an automated correction. A distance, or a course of a distance, or at least one piece of information about such a distance, about a distance or a course of a distance, with respect to two locations which are spaced apart from one another transversely to the transport direction on a front side of the pile of sheets pointing in the transport direction of the sheets to be fed, is ascertained. A distance or a course of a distance or at least one piece of information about a distance, or a course of a distance, with respect to two locations which are spaced apart from one another transversely to the transport direction on the front side of the sheet pointing in the transport direction of the sheets to be fed, is ascertained by the sensor system by the use of one or two sensors which are spaced apart from one another transversely to the transport direction.

The advantages to be achieved with the present invention are, in particular, that a deviation of the position, in particular relative to the position in the plane spanned by the sheet, and/or of the dimension, relative to the width or length, with respect to a target position or a target dimension are identified at an early stage, i.e., prior to entering an infeed into, for example, a system of the sheet treating or processing machine, and possibly a correction or consideration is already possible while sheets are being conveyed in the transport path leading through the sheet treating or processing machine.

A particularly advantageous embodiment is one in which evaluation means that evaluate the results of the at least one sensor, in particular of two sensors, are configured to record the course of the distances, as ascertained by the at least one sensor or two distance sensors, which arises during the repositioning of the pile, and to relate the courses thereof to one another and evaluate them.

By observing a potentially developing deviation, it is also possible to derive tendencies that allow early counteraction, e.g., even before a deviation exceeds a tolerable extent.

A particularly advantageous refinement using a mathematically statistical evaluation of the measurement results additionally enables an anticipatory automated positioning of the feeder head, or of the tools thereof, with respect to changed sheet lengths and/or positions. In continuation, the results can also be incorporated in the control of further units provided at the transport path, e.g., in the phase position and/or speed at downstream units and/or at transport elements, such as a sheet turning device and/or at the delivery.

By way of a sensor system according to the invention, comprising at least one, and preferably two sensors, in particular distance sensors, that sense the pile profile and are provided on the front side and/or on the rear side, it is also possible to already establish and preliminarily control a trend, by way of a curve shape obtained about a pile height, in addition to the early identification of individual non-conforming sheets, i.e., sheet having erroneous positions and/or dimensions.

Two distance sensors, which are spaced apart from one another transversely to the transport direction, can be provided as sensors that are provided on the front or rear side, or in a variant that is not shown in detail here, a laser scanner can be provided, which scans and evaluates a distance with respect to the pile in multiple locations, or continuously, in a region of the pile width.

As a result of an advantageous refinement of a sensor system that is used to ascertain deviations, which comprises sensors that are integrated into gripper tools and supply information about the load or the load curve, in particular pressure sensors integrated into or at suction grippers, and a criterion for the position and/or dimension obtained from the load curve, in particular the pressure curve, no complex measuring system that has to be adjusted to different formats is required. The above-described position of the sheet or sheets in questions is the position in the plane spanned by the sheet plane, i.e., in the case of a preferably horizontal position of the sheets in or on the pile around its or their position in the horizontal plane.

In an embodiment of a feeder of a sheet treating or processing machine that is particularly suitable for the invention, in which a pile of sheets to be processed can be received, at least two first handling tools are provided, which are spaced apart from one another transversely to a transport direction of the sheets and by which an uppermost sheet of a pile received in the feeder can be lifted off the pile, and/or at least two second handling tools, which are spaced apart from one another transversely to a transport direction of the sheets and by which an uppermost sheet lifted off the pile can be transported away from the pile in the transport direction into a transport path adjoining downstream, which, in particular downstream, leads into one or more units for treating and/or processing the sheets.

According to the invention, the feeder comprises a sensor system and evaluation means connected thereto in signaling terms, by which the sheet to be fed to the sheet treating or processing machine, e.g., while still in the pile and/or in the process of being separated and/or conveyed away from the pile into the transport path, can be monitored with respect to criteria characterizing a position and/or dimension of the sheets and be evaluated with respect to a deviation from a target or target range, and results of the evaluation can be output, via a signal link, for visualization to display means and/or for correction to control means. The evaluation means, the display means and/or the control means can be arranged at the feeder or be physically separate, but connected via signal links to the sensor system arranged at the feeder and assigned thereto.

During operation of the feeder, sheets to be fed to the treating or processing machine, e.g., while still in the pile and/or in the process of being separated and/or conveyed away from the pile into the transport path, can be monitored by way of the sensor system with respect to criteria characterizing a position and/or dimension of the sheets and be evaluated with respect to a deviation from a target or target range, and results of the evaluation can be visualized and/or used for an automated correction.

In a preferred embodiment, the sensor system, on the front side of the pile pointing in the transport direction of the sheets to be fed, comprises one or more sensors by which a distance or a course of a distance, in particular over time, or at least one piece of information about a distance or a course of a distance, in particular over time, with respect to at least two locations, which are spaced apart from one another transversely to the transport direction, on the front side of the pile pointing in the transport direction can be ascertained, and/or on the rear side of the pile, which is directed counter to the transport direction, comprises one or more sensors by which a distance or a course of distance, in particular over time, or at least pieces of information about a distance or a course of a distance, in particular over time, with respect to at least two locations, which are spaced apart from one another transversely to the transport direction, on the rear side of the pile can be ascertained.

In a particularly advantageous embodiment, the sensor system comprises two distance sensors, which are spaced apart from one another transversely to the transport direction, on the front side of the pile pointing in the transport direction of the sheets to be fed, by which in each case a distance with respect to one of two locations, which are spaced apart from one another transversely to the transport direction (T), on the downstream side of the pile can be ascertained, and/or two distance sensors, which are spaced part from one another transversely to the transport direction, on the opposing rear side of the pile, by which in each case a distance or a course of a distance, in particular over time, with respect to one of two locations, which are spaced apart from one another in the transport direction (T), on the rear side of the pile can be ascertained as a criterion charactering a position and/or dimension of sheets.

The term distance or information about the same shall, in a broader sense, also encompass a measure representing a distance and/or correlating therewith.

During operation of such a device, a distance with respect to two locations, which are spaced apart from one another transversely to the transport direction, on the downstream and/or upstream side of the pile is measured by way of the at least one of the sensors, in particular two distance sensors, which are spaced apart from one another transversely to the transport direction, on the front side and/or rear side of the pile pointing in the transport direction of the sheets to be fed.

In an advantageous refinement, the two first and/or second handling tools are implemented as suckers, wherein the sensor system comprises sensors that are configured as pressure sensors and in each case assigned to the first and/or second handling tools, by which a pressure curve in the relevant handling tool or at a location of the line path assigned to the handling tool can be ascertained as a criterion characterizing a position and/or dimension of sheets.

During operation, the sensors encompassed by the sensor system and configured as pressure sensors ascertain a pressure curve in first and/or second handling tools, which are configured as suckers, or at a location of the line path assigned to the relevant handling tool, as a criterion characterizing a position and/or dimension of sheets.

The aforementioned position is the position of a plane that is spanned by the sheet width and length and, e.g., extends horizontally in the normal case that exists for the pile arrangement.

Advantageous refinements can be derived from the dependent claims and the following exemplary embodiments.

BRIEF DESCRIPTION OF THE DRAWINGS

Exemplary embodiments of the invention are illustrated in the drawings and will be described in greater detail below.

The drawings show:

FIGS. 8A-8C a top view onto a feeder including the arrangement of distance sensors, in which FIG. 8A illustrates sensors on both sides of a pile; FIG. 8B illustrates sensors on a front side of the pile pointing in the transport direction of the sheets to be fed; and FIG. 8C illustrates sensors on a rear side of the pile, which is directed counter to the transport direction.

DESCRIPTION OF THE PREFERRED EMBODIMENT

Figure 1:
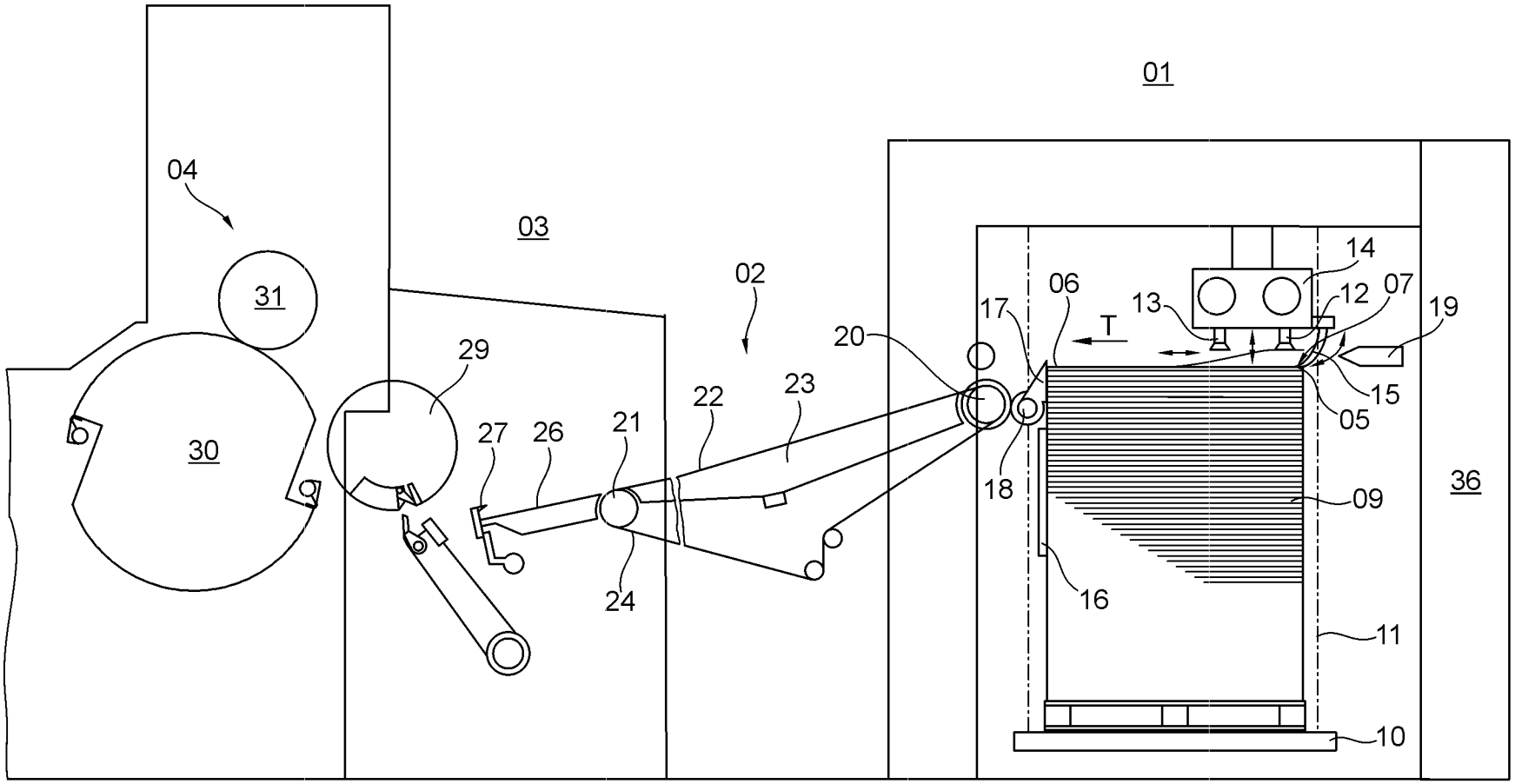
FIG. 1 a schematic illustration of a feeder and a sheet infeed of a sheet printing press arranged upstream from a printing unit in a side view.
Figure 2:
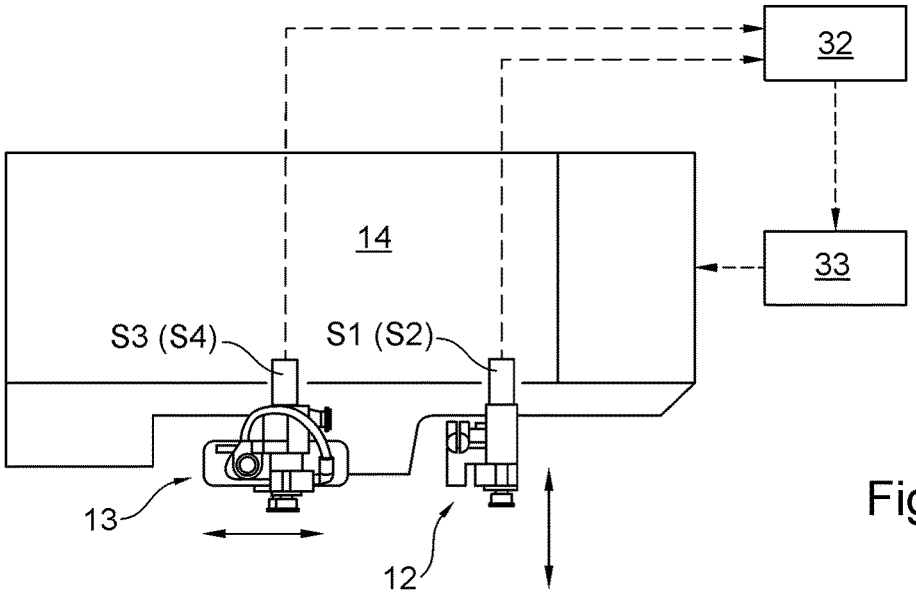
FIG. 2 a side view of an embodiment of a feeder head comprising lifting and transport tools.
Figure 3:
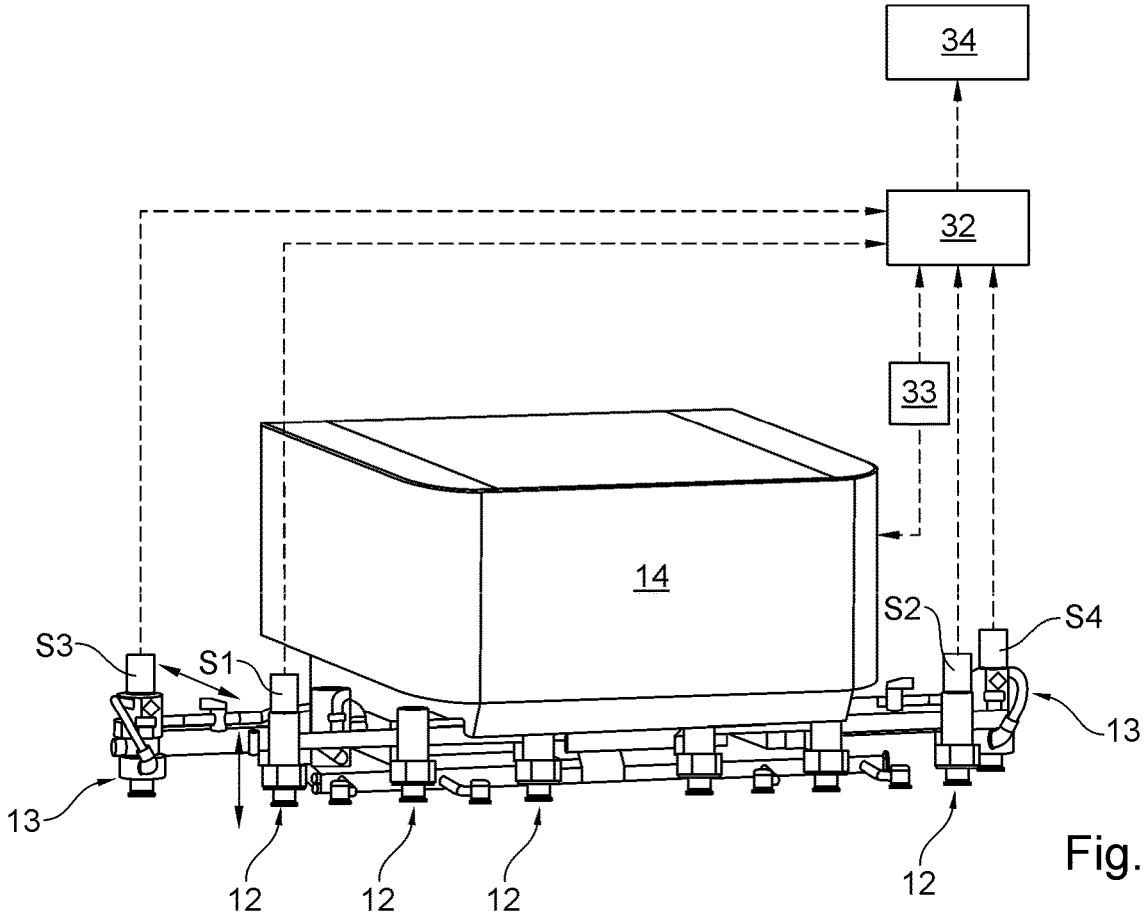
FIG. 3 a perspective view of the feeder head according to FIG. 2 obliquely from behind.

FIG. 1 shows a section of a sheet treating or processing machine, which is preferably configured as a sheet printing press. However, in principle, it may also be formed by another sheet treating or processing machine, such as a die cutter, a cutting machine, a coating machine or another machine, with the requirement of a one-sided sheet separation.

The sheet treating or processing machine described here based on the example of a sheet printing press comprises a feeder 01, e.g., a pile or sheet feeder, a feed table 02, a sheet infeed 03 and, adjoining the sheet infeed 03, one or more units 04 for treating and/or processing the sheets 06, which are not shown in detail here, such as a printing unit 04, a coating unit, a drying unit, a calendering unit or the like.

In the feeder 01, a pile 09, for example a pile of sheets 09, is placed on a pile board 10. The pile board 10 is height-adjustable using a lifting device 11 so as to maintain the uppermost sheet 06 of the pile of sheets 09, regardless of the number of sheets 06 in the pile 09, at a fixed or only slightly variable height that is suitable for transferring the sheets 06 to the feed table 02. In the illustration of FIG. 1, the sheets 06 of the pile 09 are located directly on the pile board 10; however, a pallet could also be located between the pile 09 and the pile board 10, on which the pile 09 has been transported to the pile board 10 and placed thereon and the height of which is not known, so that the height of the pile 09, or the number of sheets 06 contained in the pile 09, cannot be inferred from the position of the lifting device 11.

A front stop 16 defines a vertical plane in which the leading edges of the sheets 06 of the pile of sheets 09 are positioned. A sheet flap 17 can be pivoted counterclockwise about a flap shaft 18 between the position shown in FIG. 1, which extends the front stop 16 in a rectilinear manner toward the top, into a substantially approximately horizontal position, in which it supports the transport of the sheets 06 to the downstream feed table 02.

The feeder 01 comprises various tools 12; 13, which here are combined in a feeder head 14, for breaking the pile 09 down into individual sheets 06 and for transporting the sheets 06 away to the printing units 04, and possibly other units of the sheet printing press.

These tools 12; 13 include multiple so-called suckers 12, in particular handling tools 12 configured as separating or lifting suckers 12, in particular lifting tools 12 that are arranged above a rear edge 05 of the pile 09 in the transport direction T of the sheets 06 and can essentially be moved in a vertical direction. Each of the separating suckers 12 comprises a suction cup, which is open toward the bottom, toward the pile 09, and made of flexible plastic material, the suction cups being connected at the upper ends to a shared vacuum source. The vacuum pressure has to be sufficient for the suction cups to be held securely to the sheet 06 to be lifted off the pile 09, but must not be so strong that it pulls the sheet 06 into the suction cup, thereby deforming it. When not all suction cups of the separating suckers 12 rest against a sheet 06 to be lifted, the air current across an uncovered suction cup can prevent the vacuum pressure necessary for lifting from being achieved in the other suction cups. To lift a sheet 06 reliably, it is therefore necessary that all separating suckers 12 simultaneously make contact with it. For this purpose, each separating sucker 12 can be movable relative to the feeder head 14 by way of a dedicated drive, in particular a linear actuator, and preferably a shared frame, in which all separating suckers 12 are held, can be moved relative to the feeder head 14 by way of a rapid, powerful main actuator, so as to pick the sheet 06 up from the pile 09 and lift it along the rear edge 05, and the separating suckers 12 can be adjusted relative to the frame by way of auxiliary actuators to compensate for unevenness on the upper side of the pile 09, while ensuring contact of all separating suckers 12 with the sheet 06 to be lifted, wherein the auxiliary actuators can be slower and have less lift than the main actuator.

A tool 15 configured as a feeler foot 15 can be provided as another tool 15 of the feeder head 14, which can be moved between a holding position, which is shown in FIG. 1 and presses on the pile 09 along the rear edge 05, and an idle position, which is raised compared to the holding position and offset counter to the transport direction T behind the rear edge 05. The feeler foot 15 is positioned in the holding position when the uppermost sheet 06 of the pile 09 has been lifted by the separating suckers 12 along the rear edge 05 to prevent sheets 06 of the stack 09 located therebeneath from being disturbed when a blower device 19 arranged behind the rear edge 05 at the height of the upper side of the pile 09 blows air into an open gap 07 between the lifted sheet 06 and the remaining pile 09.

Furthermore, tools 13, e.g., suckers 13, in particular handling tools 13 configured as transport suckers 13, in particular transport tools 13, are provided at the feeder head 14, which carry out a predominantly vertical movement in or counter to the transport direction T. Similarly to the separating suckers 12, the transport suckers 13 comprise flexible suction cups, to which vacuum pressure is applied after the separating suckers 12 have been lifted so as to draw the lifted sheet 06 to them. At the same time, vacuum pressure is no longer applied to the separating suckers 12, so that these release the sheet 06. The air that is blown into the gap 07 by the blower device 19 lifts the sheet 06 on its entire surface off the pile 09 and forms an air cushion beneath the sheet 06, on which the sheet 06, driven by the horizontal movement of the transport suckers 13, is then pushed across the sheet flap 17, which is then pivoted into the horizontal, onto the feed table 02.

The aforementioned suckers 12; 13 can alternatively also be configured to operate according to the Bernoulli principle, as so-called Bernoulli suckers for short. What was described above is to be applied accordingly to this case, with the difference that these suckers are connected to an overpressure source and are operated with overpressure compared to the ambient air.

In the exemplary embodiment, the feed table 02 arranged downstream from the feeder 01 is configured as a suction feed table 02. It preferably comprises two rollers 20; 21, for example one drive roller 20 and one diverting roller 21. A one-piece or multi-piece table top 22 extends between the two rollers 20; 21. The table top 22 forms the upper side of a suction box 23 which is perforated in many places. At least one conveyor belt 24 wraps around the drive rollers 20 and the diverting rollers 21, which, similarly to the table top 22 across which it extends, is perforated in many places so as not to adhere to the table top 22 by suction, even though a sheet 06 is suctioned against the conveyor belt 24.

The rotational speed of the conveyor belt 24 is generally less than the ratio of the edge length of the sheets 06 to the cycle time of the feeder head 14 so that, when the transport suckers 13 start to push a new sheet 06 over the sheet flap 17, the preceding sheet 06 has not fully passed it yet. In this way, an underlapped stream of sheets 06 is formed on the conveyor belt 24, in which the number of the mutually overlapping sheets 06 is variable, depending on the rotational speed, edge length and cycle time.

The sheet infeed 03, to which the sheets 06 are conveyed from the revolving conveyor belt 24, comprises a feed table 26 and, at a rear edge of the feed table 26 in the transport direction T, stops 27 that can be recessed from their stop position, which is shown in FIG. 1 and blocks the conveyor path of the sheets 06, so as to clear the path for a sheet 06 resting against the stops 27 to the downstream printing unit 04, of which a transfer drum 29, a counterpressure cylinder 30 and a blanket cylinder 31 are shown in FIG. 1.

Figure 7:
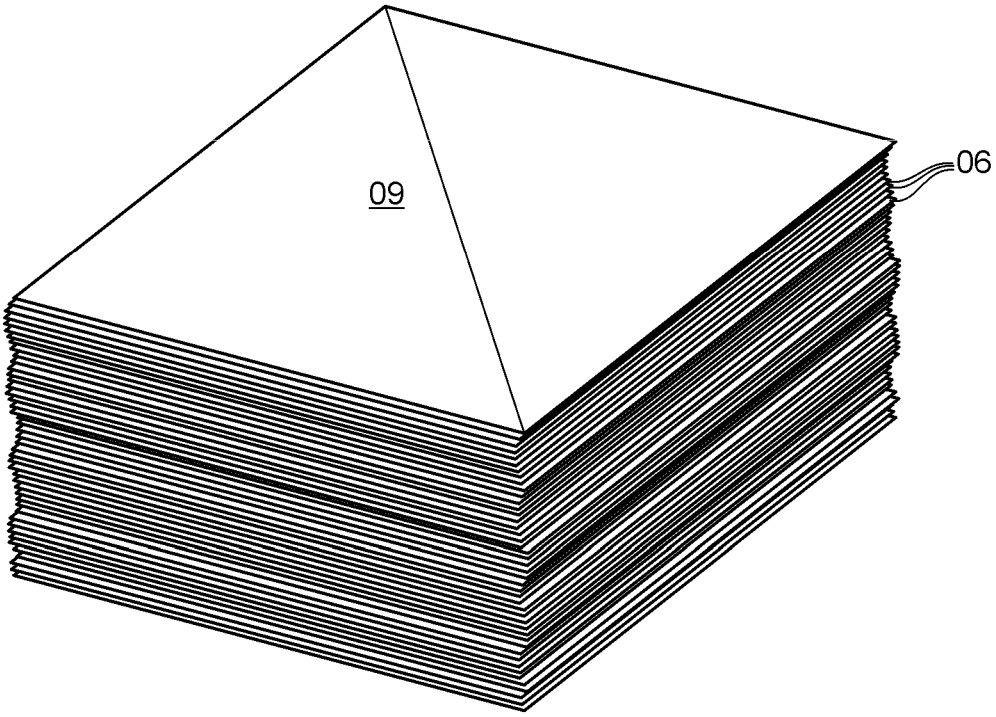
FIG. 7 a pile of sheets with an exaggerated illustration of position or dimension errors.
Figure 8A:
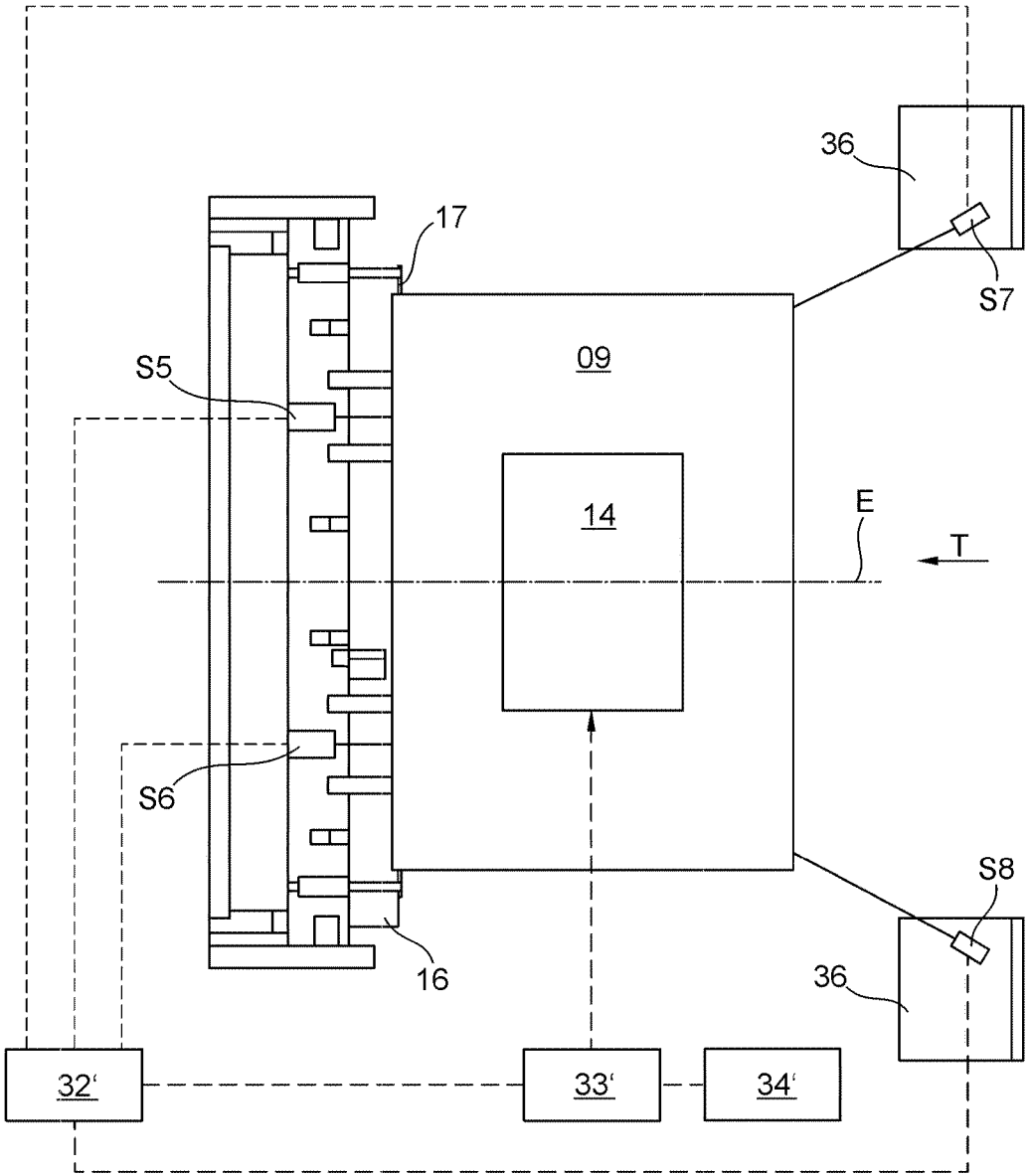
Figure 8B:
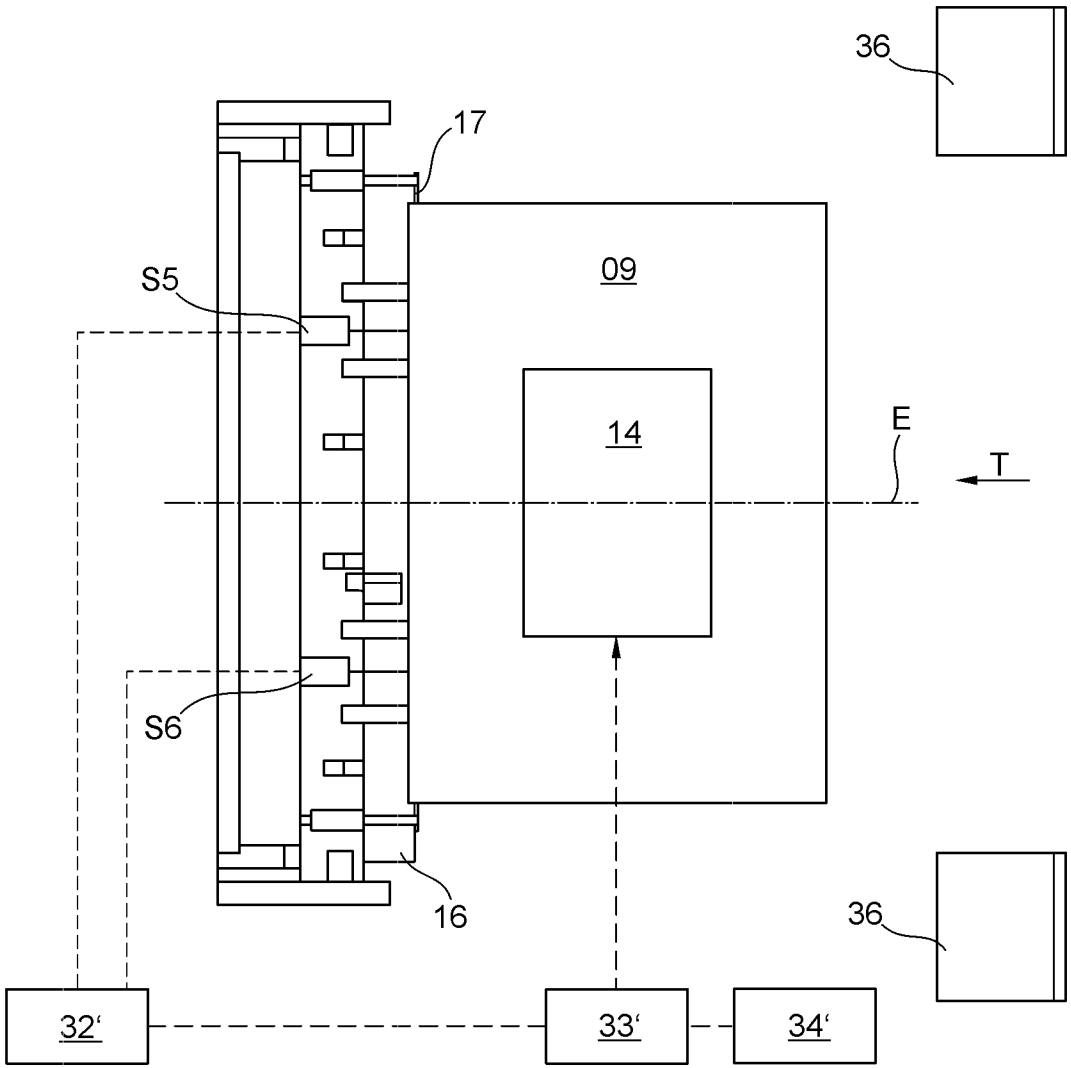
Figure 8C:
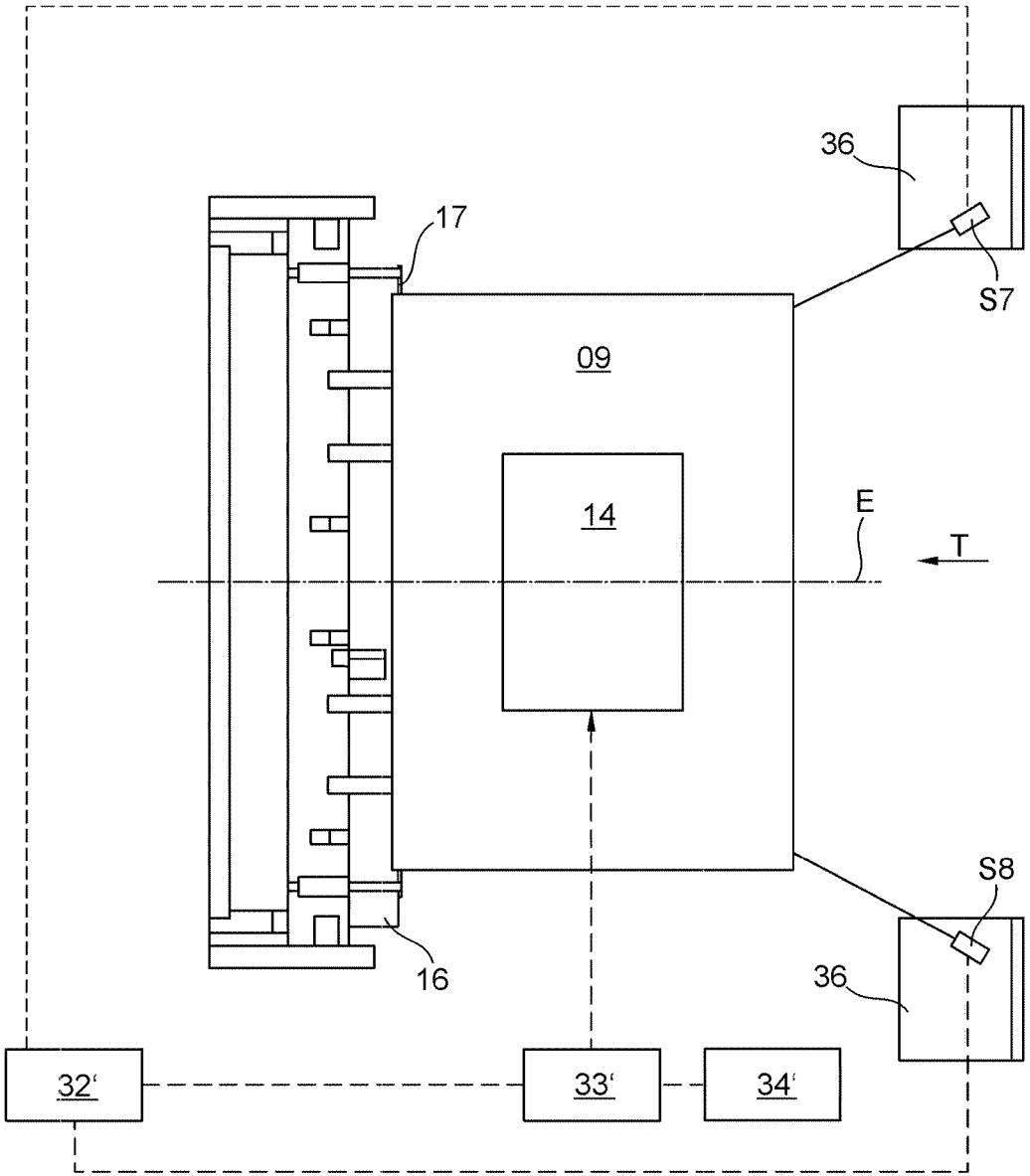

The aforementioned transport of the sheets 06 via the sheet infeed 03 and one or more units, such as printing units 04, up to a delivery can be subject to disruptions that occur due to errors in the position or dimension of the transported sheets 06. These errors can already have been caused during the infeed of the sheets 06 in the feeder 01 since the sheets 06 in the pile 09 can vary in terms of the cut length or, possibly, are arranged offset or obliquely in the pile 09 (see, e.g., FIG. 7 in the exaggerated illustration).

To ascertain deviations in the position and/or dimension of the sheets 06 to be conveyed by the feeder 01 into the treating or processing machine from a target position or a target dimension, the feeder 01 now comprises a sensor system, the output signals of which can be evaluated or are evaluated by way of evaluation means 32; 32', which are only schematically indicated here, in particular accordingly configured data processing means 32; 32', with respect to possibly present deviations in the position and/or dimension (see, e.g., FIG. 2 and FIG. 3 or FIGS. 8A-8C). The evaluation result can be visualizable on a display means 34; 34', for example, via an output interface. The aforementioned position is the position in a plane that is spanned by the sheet width and length and, e.g., extends horizontally in the normal case of a planar positioning that exists for the pile arrangement.

In a particularly advantageous refinement, control means 33; 33', e.g., data processing means 33; 33' comprising a control logic implemented therein, can be assigned to the evaluation means 32; 32', by which, as a function of the result of the evaluation, a correction that is counter to the deviation can be brought about or is brought about, e.g., by way of a change in the position and/or location of handling tools 12; 13, in particular of the feeder head 14 comprising the handling tools 12; 13, for example by activating one or more corresponding drive means via an assigned drive controller. In a refinement, this takes place automatically by way of the assigned control means 33; 33'.

In principle, an arbitrarily configured sensor device can be provided, based on the output signal of which criteria that characterize a position and/or dimension of the sheets 06 can be obtained, and based on which deviations in the position and/or dimension of the sheets 06 to be conveyed by the feeder 01 into the treating or processing machine from a target or target range can be established and, ideally, quantified.

In an advantageous refinement of the embodiment of the feeder set out in greater detail below, comprising at least one downstream and/or at least one upstream sensor S5; S6; S7; S8, the sensor system can comprise sensors S1; S2; S3; S4. which are assigned to at least some of the handling tools 12; 13 that receive the sheets 06, in particular the suckers 12; 13, and configured as pressure sensors S1; S2; S3; S4 and by which a pressure P(S1); P(S2) or pressure curve in the sucker 12; 13 or at a location of the line path assigned to the sucker 12; 13 can be ascertained. In this embodiment, a criterion for the position and/or dimension of the sheets 06 is obtained from a pressure P(S1); P(S2) or, in particular, a pressure curve. During active operation for suckers 12; 13 connected to a vacuum source, this ascertainable pressure P(S1); P(S2) represents a pressure curve at a vacuum pressure, i.e., a curve at a pressure P(S1); P(S2) that is below the ambient area, and in the case of suckers 12; 13 operating according to the Bernoulli principle, this represents a pressure curve at overpressure, i.e., a curve at a pressure P(S1); P(S2) above the ambient area. In principle, when using suckers 12; 13, a load curve could also take place in another manner by appropriate sensors S1; S2; S3; S4, for example by mechanical force sensors, instead of by way of the pressure curve.

In a preferred embodiment shown here of the refinement, a sensor S1; S2, in particular a pressure sensor S1; S2, is in each case assigned to two separating suckers 12 that are spaced apart from one another transversely to the transport direction T, in particular integrated therein, by which a load curve or pressure curve can be ascertained when the sheets 06 are being lifted. Instead or preferably in addition, a sensor S3; S4, in particular a pressure sensor S3; S4, is in each case assigned to two transport suckers 13 that are spaced apart from one another transversely to the transport direction T, in particular integrated therein, by which a load curve, and in particular a pressure curve, can be ascertained when the sheets 06 are being transported along the transport direction T. Out of the respective plurality of handling tools 12; 13, i.e., the lifting tools 12 and the transport tools 13; a sensor S1; S2; S3; S4 is preferably assigned to two handling tools 12; 13 that are transversely spaced apart, which are both located within a width of a smallest sheet format to be fed and/or which are located the furthest apart in the smallest sheet format to be fed. For example, these are the handling tools 12; 13 located the furthest to the outside, which, however, are arranged so as to cover also the narrowest format. In principle, it is also possible for more than two handling tools 12; 13 of the same type to be assigned to sensors S1; S2; S3; S4.

The pressure sensors S1; S2; S3; S4 may, in principle, be provided in any given location in the line path that is assigned to the relevant sucker 12; 13 and subjected to the working pressure, i.e., vacuum pressure or overpressure. However, they are advantageously arranged close to the sucker or, in particular, directly at or in the sucker 12; 13 itself.

The load curve or pressure curve at the individual handling tools 12; 13, in particular at two handling tools 12; 13 of the same type and/or in correlation with one another, can, in principle, be evaluated in any given manner and assessed compared to a target. A feature A(S1); A(S2); A(S1, S2) that is characteristic of the level and/or the course can be extracted or formed, e.g., for a sheet 06 having a correct position and dimension, and can be compared as a target to a result for the feature A(S1); A(S2); A(S1, S2) that presently arises while the sheets are being received and transported, and the result of the comparison can be evaluated with respect to deviations. It is particularly advantageous when the target state is determined by way of measurement over a multiplicity of received and conveyed sheets 06, using statistical methods, e.g., as a mean value M1; M2, having a confidence range γ; γ(S1); γ(S2) that, for example, is tolerated or tolerable as a deviation. It can be advantageous when this determined mean value M1; M2 is not static for further production, but is ascertained over a defined multiplicity of, e.g., more than 50 most recently considered events for the feature A(S1); A(S2); A(S1, S2) as the target having a confidence range γ; γ(S1); γ(S2).

Figure 4:
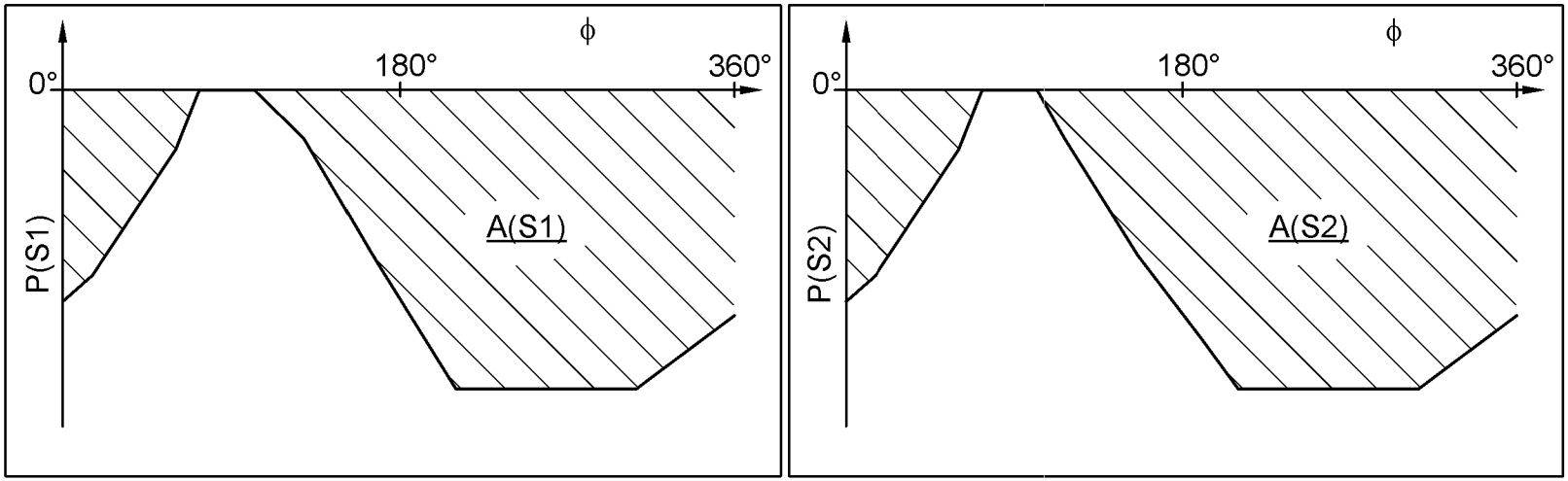
FIG. 4 a simplified representative illustration of a pressure curve at two suckers and for the resulting area.

In a preferred embodiment shown here, a measure of the areas A(S1); A(S2) that arise under the curve, i.e., between the curve and the abscissa, when plotting the course for the ascertained pressure P(S1); P(S2) against the entire or at least a portion of a receiving and conveying cycle of the relevant suckers 12; 13 for receiving and conveying a sheet 06, i.e., a movement cycle until the starting position has been assumed, is used as the feature A(S1); A(S2); A(S1, S2). In the case of overpressure, such an area lies above the abscissa, in the case of vacuum pressure, it lies below the abscissa. This is schematically shown by way of example, e.g., in FIG. 4 based on the vacuum pressure that is present over a movement cycle of the left and right lifting sucker 12 and the areas that lie between the particular curve and the axis related to the tool phase position ϕ. The same is to be applied accordingly to suckers 12; 13 operated at overpressure, with the difference that the areas lie in the positive range for the pressure P(S1); P(S2). From the obtained typical courses of the measured values, it is possible to ascertain the areas A(S1); A(S2) using integrals, mathematical approximation methods, such as numerical integration, or a trapezoidal rule.

Figure 5:
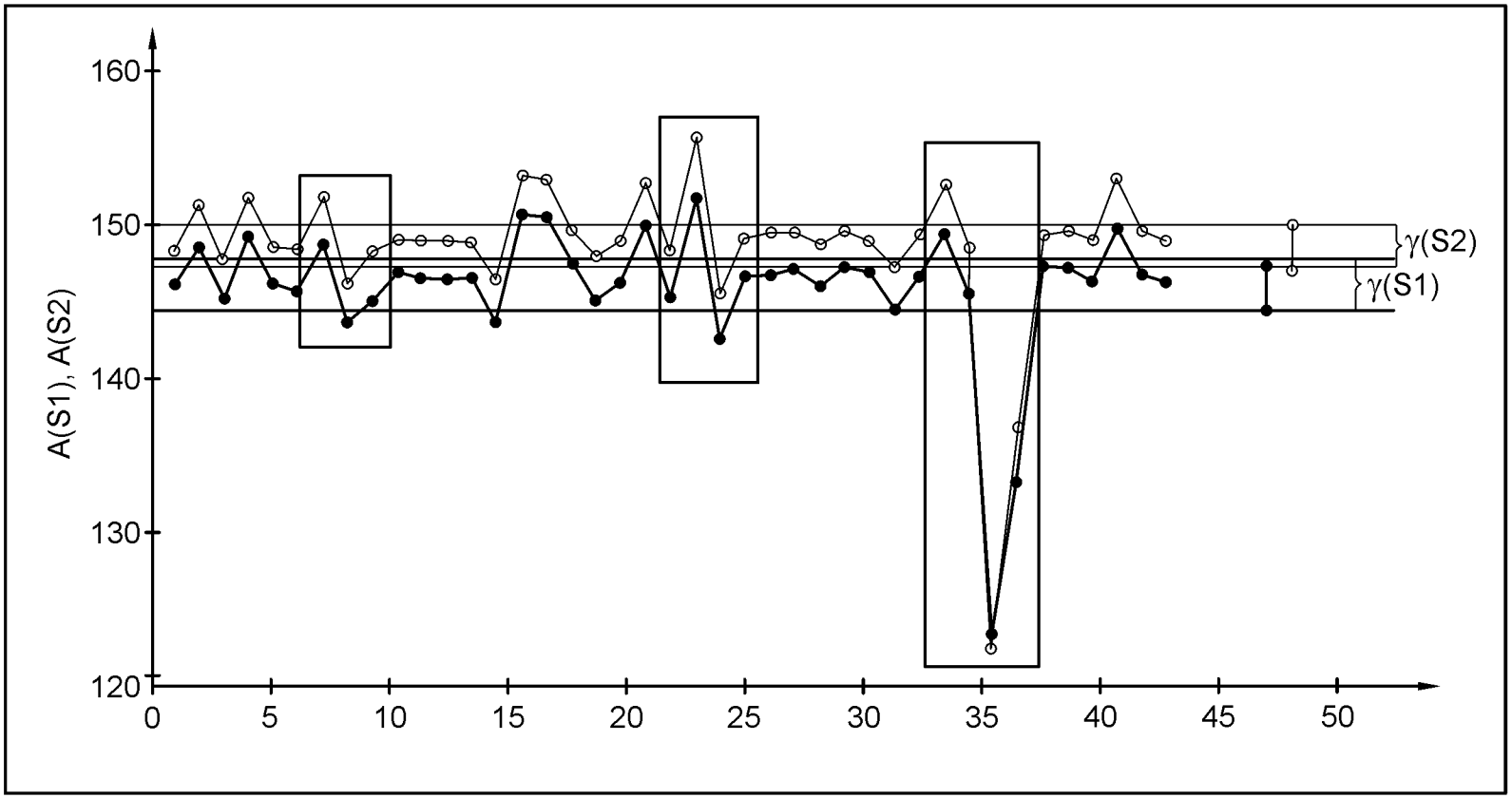
FIG. 5 an example of the variance of values for the areas of the pressure curves at two suckers, including identification of significant outliers.
Figure 6:
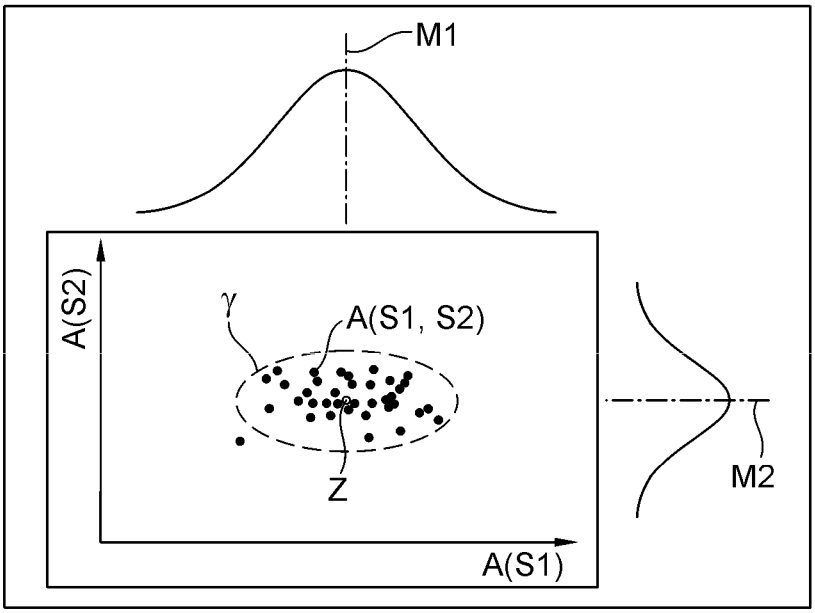
FIG. 6 an exemplary illustration of the arrangement of values, resulting for two suckers, for the areas in a point cloud, including the representation of a confidence range in the form of an ellipse.

If abnormalities occur in the defined feature A(S1); A(S2), e.g., significant outliers from a defined tolerance range, e.g., the relevant confidence range γ(S1); γ(S2), as is shown by way of example in FIG. 5, for example, conclusions can be drawn as to certain errors. When comparing consecutive results for the relevant feature A(S1); A(S2), or in particular combining the results of features A(S1); A(S2) at multiple handling tools 12; 13 or suckers 12; 13, which here are the values for the areas A(S1); A(S2), it is possible to identify a pattern in the event of an error, which allows the causes of the corresponding error patterns to be inferred, and thereby enables an early, preferably automated, correction of the relevant handling tool 12; 13. For correcting a sheet 06 that is identified as an early sheet, this would be, for example, a displacement of at least the transport tools 13, preferably however of the feeder head 14 comprising these transport tools 13, toward the pile rear edge. As a result of the pattern identification, all traditional error patterns, such as early and late sheets, skew sheets, double sheets or bundle layers, can already be reliably identified as they arise and avoided.

The results ascertained for the two transport tools 12; 13 of the same type, for example the lifting tools 12, which here are the features A(S1); A(S2) or areas A(S1); A(S2) ascertained from the pressure curves of, e.g., the lifting suckers 12, can be depicted in a diagram as a point cloud, for which, for example, a center point or a center Z is calculated. By applying mathematically statistical methods, for example the Gaussian distribution, or normal distribution, to the distribution of the values of the feature A(S1, S2) combined from the two areas A(S1); A(S2), it is possible to construct, e.g., a confidence ellipse, within which a percentage of all points corresponding to the confidence value γ lie for the combined features A(S1, S2). For example, a possible confidence value γ is γ96. The ellipse thus allows information to be provided about the reliability of the separation of the sheet 06 of the feeder 01. If values outside this ellipse occur with increased frequency, this indicates a problem with the separation of the sheets 06 at an early stage. The operator of the treating or processing machine can thus still intervene before a stoppage occurs and correct the settings.

The combined or linked consideration of the results for the characteristic feature A(S1); A(S2), which here are the areas A(S1); A(S2) of multiple handling tools 12; 13, can be used to derive an error type, e.g., from early or late sheets, skew sheets, double sheets, or bundle layers.

In continuation of the concept related to the confidence ellipse, results of a measurement at handling tools 13; 12 of the other type, for example at transport tools 13, can be taken into consideration in a three-dimensional ellipsoid. Corresponding information about upcoming problems can then be obtained via an even broader data set.

In an aforementioned particularly advantageous refinement, according to which control means 33, e.g., data processing means 33 including an implemented control logic, are assigned to the evaluation means 32 for automation purposes, the deviations from the target, e.g., a temporal pattern and/or the position of a point located outside the confidence range, are evaluated in a data processing-based manner, and a countermeasure, e.g., a position correction of handling tools 12; 13, in particular of the feeder head 14 comprising the handling tools 12; 13, is initiated in an automated manner based on the result of the aforementioned deviations or automatically in response to the impending deviations. In this case, the operator no longer has to intervene, or at least only in an emergency. Evaluation means 32 and control means 33 can be integrated in the same data processing unit, or these can be spatially separate and only be connected in terms of signaling.

In principle, regardless of the aforementioned refinement including an ascertainment and evaluation of the load curve and the creation of a feature A(S1); A(S2) that allows the position and/or format of the sheets 06 to be fed to be assessed, however, in an advantageous refinement together with such a refinement, an embodiment according to the invention and/or a particularly preferred embodiment of a feeder comprises a sensor system including at least one sensor S5; S6 on the side that points in the transport direction T of the sheets 06 to be fed, i.e., on the front side of the pile 09, and/or at least one sensor S7; S8 on the side that is counter to the transport direction T, i.e., on the rear side of the pile 09, by which a distance or, in particular a course of a distance over time with respect to at least two locations, which are spaced apart from one another transversely to the transport direction T and, in particular, are situated at the same height, on the downstream side of the pile 09 can be ascertained or at least information about the distance or the course of the distance can be ascertained. The respective sensor S5; S6; S7; S8 is preferably arranged at a height that is below the upper pile edge and/or is at least arranged so as to be directed at a location of the pile that is located below the upper pile edge and/or at the relevant pile side from the front or rear side.

In one variant embodiment not shown in detail here, a sensor S5; S6; S7; S8 configured as a laser scanner can be provided for this purpose on the front and/or rear side, which scans a distance or a course of a distance, in particular over time, with respect to the pile on at least one section of the pile width in a localized manner in multiple spots, or continuously, or at least provides information regarding the distance or the course of the distance and evaluates the ascertained distance or the relevant information. As a result of an evaluation in at least two locations, which are spaced apart from one another and located at the same height, it is thus possible to ascertain information about the alignment of the pile edge at the height of these locations.

In an embodiment which is shown here and can be implemented using simple means, two sensors S5; S6, in particular distance sensors S5; S6, are provided on the side that points in the transport direction T of the sheets 06 to be fed, i.e., on the front side of the pile 09, by which in each case a distance with respect to a location, which is in particular situated at the same height, on the downstream side of the pile 09 can be measured. These sensors S5; S6 are spaced apart from one another transversely to the transport direction T and are preferably provided at the same height and are arranged aligned horizontally, perpendicularly to the transport direction T. They are preferably arranged in the region of front stops 16. The sensors S5; S6 are preferably arranged at a height that is below the upper pile front edge and/or at least arranged so as to be directed at a location of the pile which is situated below the upper pile front edge. They are arranged on both sides of an imaginary vertically extending center plane E, which cuts the pile 09 in half, as viewed in the transverse direction, but can, for example, be horizontally displaceable corresponding to the sheet format to be processed.

Instead or preferably in addition to the front-side sensors S5; S6, the sensor system, on the opposite side, which is to say, the side facing away from the treating or processing machine, i.e., the rear side of the pile 09, comprises two sensors S7; S8, in particular distance sensors S7; S8, by each of which a distance with respect to a location, which is in particular situated at the same height, on the rear side of the pile 09 can be measured. The sensors S7; S8 are likewise spaced apart from one another transversely to the transport direction T and preferably provided at the same height and aligned horizontally, perpendicularly to the transport direction T. The sensors S7; S8 are preferably arranged at a height that is below the upper pile rear edge and/or at least arranged so as to be directed at a location of the pile which is situated below the upper pile rear edge. They are, for example, arranged in columns 36 of a feeder stand, so that the accessibility for pile changing purposes is not impaired.

A distance measurement at the front and/or rear sides with respect to the pile 09 by means of the sensors S5; S6; S7; S8 is carried out continuously or at intervals during operation while the pile is being lifted. To detect the pile profile of a pile 09 located in the feeder 01, the measurement values are collected at the two, preferably four, sensors S5; S6; S7; S8 and evaluated. In the process, a profile for the lateral pile limitation in the portion of the pile 09 which is situated above the considered locations and was already conveyed vertically across these locations is provided by the front-side and/or rear-side distance sensors S5; S6; S7; S8 on the front and/or rear sides of the pile 09 at two locations, or at two respective locations that are spaced apart from one another transversely to the transport direction T.

For this purpose, evaluation means 32', serving as data processing means 32', are configured to record the course of the distances which arises during repositioning, i.e., during lifting that takes place to maintain the position of the pile upper side when the respective uppermost sheets 06 are being removed, the distances having been ascertained by the at least two, preferably four sensors S5; S6; S7; S8, and to relate their courses to one another and evaluate them.

Results of the evaluation can, for example, be output to a display means 34' and/or a control means 33', in particular comprising appropriately programmed data processing means 33'. In this embodiment, criteria characterizing the position and/or dimension of the sheets 06 are derived from distances, in particular a course of distances between the sensors S5; S6; S7; S8 and the pile 09. Preferably, mathematically statistical methods are employed during the evaluation.

It is possible, for example, to ascertain, by way of the measured values of the at least two, in particular four, sensors S5; S6; S7; S8, a profile of the pile 09, e.g., at least on the side that is scanned by sensors S5; S6; S7; S8, which provides information about the length and/or the position, possibly also of individual sheets 06. Deviations in the length and/or in the position of the sheets 06 can be statistically evaluated.

The course of the measured value series, recorded over the time, of the sensors S5; S6; S7; S8 arranged on both sides of the center plane E, agrees, if necessary within permissible error tolerances, when the sheets 06 in the pile 09 were cut correctly.

If differences arise in the respective courses of the curves of the front and rear sides, the sheets 06 are too long or too short. Both conditions are unfavorable for the separation of the sheets 06.

In an advantageous refinement, the aforementioned control means 33' are provided, by which such a deviation in the dimensions, which here is a deviation in the length of sheets 06, is identified from the measured values and is counteracted by changing the position and/or location of handling tools 12; 13, in particular of the feeder head 14 comprising the handling tools 12; 13, for example by activating one or more appropriate drive means, in one refinement in an automated manner, so as to prevent an error in the separation.

Having knowledge of the length of the sheets 06, which, for example, can be ascertained or is ascertained by evaluating the front-side and rear-side distance measurement values, can also be useful for further units of the treating or processing machine and be incorporated in the control thereof, such as at a sheet turning device and/or at the delivery.

If the measured value series of the sensors S5; S6; S7; S8 located on the one side and on the other side of the center plane E are different, the differences between the front and rear sides, however, are equally large on both sides, this indicates skew sheets 06 in the pile 09. Such deviations in the position, i.e., skew sheets, can thus likewise be detected at an early stage and be corrected, e.g., in an automated manner, by setting and/or positioning the feeder head 14.

The combined or linked consideration of the results for the characteristic criterion, which here is the course of the distance, in particular over time, in multiple locations of the pile 09, can be used to derive an error type, e.g., from early or late sheets, skew sheets, double sheets or bundle layers.

The aforementioned control means 33; 33' are preferably provided for the described embodiments of the sensor system comprising the pressure sensors and/or the distance sensors, including assigned evaluation means 32; 32', the control means being connected, in terms of signaling, to the evaluation means 32; 32' and to drive means that indirectly or directly actuate the first and/or second handling means 12; 13 so as to position them as a function of the result of the evaluation. Indirect driving can take place in that the feeder head 14 comprising the handling tools 12; 13 is actuated or positioned.

While a preferred embodiment of a feeder of a sheet treating or processing machine, and a method for detecting or correcting sheets having deviation positions or dimensions in a sheet feeder of a sheet treating or a processing machine, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A feeder of a sheet treating or processing machine, in which a pile of sheets to be processed can be received, comprising at least two handling tools, which are spaced apart from one another transversely to a transport direction of the sheets and by which an uppermost sheet can be transported away from the pile in the transport direction into a transport path adjoining downstream, wherein:

a sensor system is provided at least one of:

on a front side of the pile pointing in the transport direction of the sheets, and comprises at least one sensor, by which a distance with respect to at least two locations, which are spaced apart from one another horizontally and transversely to the transport direction, on the front side of the pile can be ascertained, or on a rear side of the pile, which is directed counter to the transport direction, and comprises at least one sensor by which a distance with respect to at least two locations, which are spaced apart from one another horizontally and transversely to the transport direction, on the rear side of the pile can be ascertained.

2. The feeder according to claim 1, characterized in that:

the sensor system, on the front side of the pile pointing in the transport direction of the sheets, comprises two sensors, which are spaced apart from one another transversely to the transport direction and configured as distance sensors and by which in each case a distance or a course of a distance with respect to one of the at least two locations, which are spaced apart from one another horizontally and transversely to the transport direction, on the downstream sides of the pile can be ascertained, and/or the sensor system, on the rear side of the pile directed counter to the transport direction, comprises two sensors, which are spaced apart from one another transversely to the transport direction and configured as distance sensors and by which in each case a distance or a course of a distance with respect to one of the at least two locations, which are spaced apart from one another horizontally and transversely to the transport direction, on the rear side of the pile can be ascertained.

3. The feeder according to claim 1, characterized in that:

the sensor system, on the front side pointing in the transport direction of the sheets and/or on the rear side of the pile pointing counter to the transport direction of the sheets, comprises a sensor configured as a laser scanner by which, with respect to the at least two locations spaced apart from one another horizontally and transversely to the transport direction, a distance or a course of a distance on a section situated between the at least two locations can be ascertained.

4. The feeder according to claim 1, characterized in that:

an evaluation means is connected to the sensor system in terms of signaling, by which sheets to be fed can be monitored with respect to criteria that are obtained from the distances and that characterize a position and/or dimension of the sheets, and are evaluated with respect to a deviation from a target or target range, and results of the evaluation can be output, via a signal link, for visualization to a display means and/or for correction to a control means.

5. The feeder according to claim 1, characterized in that: the sensors are arranged at a height that is below an upper pile edge and/or at least are arranged so as to be directed at a location of the pile that is below the upper pile edge.

6. The feeder according to claim 1, characterized in that: an evaluation means is configured to record courses of the distances, ascertained by distance sensors, which arises during repositioning of the pile, and to relate the courses to one another and evaluate them.

7. The feeder according to claim 1, characterized in that: a control means connected to an evaluation means in terms of signaling is connected, in terms of signaling, to a drive means that indirectly or directly actuates at least one of the least two handling tools so as to position the at least one handling tool as a function of a result of evaluation.

8. The feeder according to claim 1, characterized in that: the at least two handling tools are configured as suckers, and that the sensor system comprises sensors, which are each assigned to respective ones of the at least two handling tools and configured as pressure sensors and by which a pressure curve can be ascertained, as a criterion characterizing a position and/or dimension of sheets, in the respective handling tool or in a location of the line path assigned to the respective handling tool.

9. The feeder according to claim 8, characterized in that: an evaluation means is configured to extract or form a feature that is characteristic of a course from the ascertained pressure curve, using mathematical methods, and to output the feature as a result to a display means and/or a control means.

10. A method for detecting and/or correcting sheets having deviating positions and/or dimensions in a feeder of a sheet treating or processing machine, in particular using a device according to claim 1, to successively transport sheets away from the pile in the transport direction into the transport path adjoining downstream by means of the at least two handling tools, which are spaced apart from one another transversely to the transport direction of the sheets, wherein sheets to be fed to the treating or processing machine are monitored by means of the sensor system with respect to a position and/or dimension of the sheets and evaluated, and results of the evaluation are visualized and/or used for an automated correction.

11. The method according to claim 10, characterized in that:

in each case a distance or a course of a distance with respect to one of the at least two locations, which are spaced apart from one another horizontally and transversely to the transport direction, on the front side of the pile is ascertained by means of two sensors, which are spaced apart from one another transversely to the transport direction and configured as distance sensors, on the front side of the pile pointing in the transport direction of the sheets, and/or in each case a distance or a course of a distance with respect to one of the at least two locations, which are spaced apart from one another transversely to the transport direction, on the rear side of the pile is measured by means of two sensors, which are spaced apart from one another transversely to the transport direction and configured as distance sensors, on the rear side of the pile facing away from the transport path.

12. The method according to claim 10, characterized in that results obtained by way of multiple sensors are linked and used to derive and/or correct an error type.

13. The method according to claim 10, characterized in that:

a profile for a lateral pile limitation of a portion of the pile which is situated above considered locations and was already conveyed vertically across these locations is provided by front-side and/or rear-side distance sensors on the front and/or rear sides, respectively, of the pile at two locations, which are spaced apart from one another transversely to the transport direction.

14. The method according to claim 10, characterized in that:

a change in a position of one or more of the handling tools or of a feeder head comprising the handling tools is carried out, for correcting an undesirable erroneous position or deviation, by activating one or more drive means provided for positioning purposes.

* * * * *